United States Patent [19]

Ray et al.

[11] 4,154,283

[45] May 15, 1979

[54] PRODUCTION OF IMPROVED METAL ALLOY FILAMENTS

[75] Inventors: Ranjan Ray, Morristown, N.J.; Carl F. Cline, Walnut Creek, Calif.; Donald E. Polk, Boston, Mass.; Lance A. Davis, Morristown, N.J.

[73] Assignee: Allied Chemical Corporation, Morristown, N.J.

[21] Appl. No.: 764,149

[22] Filed: Jan. 31, 1977

Related U.S. Application Data

[63] Continuation of Ser. No. 552,673, Feb. 24, 1975, abandoned.

[51] Int. Cl.[2] ..... B22D 11/10

[52] U.S. Cl. ..... 164/64; 164/65; 164/87; 164/256; 164/423

[58] Field of Search ..... 164/64, 65, 87, 256, 164/258, 276, 423, 429

[56] References Cited

U.S. PATENT DOCUMENTS 3,862,658 1/1975 Bedell ..... 164/87

FOREIGN PATENT DOCUMENTS 736310 9/1955 United Kingdom ..... 164/276

*Primary Examiner*—Richard B. Lazarus
*Attorney, Agent, or Firm*—Gerhard H. Fuchs

[57] ABSTRACT

Metal alloy filaments having improved surface characteristics and enhanced mechanical properties are extracted from a source of molten metal alloy using a quenching wheel in a partial vacuum.

5 Claims, 12 Drawing Figures

PRODUCTION OF IMPROVED METAL ALLOY FILAMENTS

This is a continuation, of application Ser. No. 552,673 filed Feb. 24, 1975 now abandoned.

BACKGROUND OF THE INVENTION

1. Field of the Invention

The invention relates to the production of improved metal alloy filaments extracted from molten metal alloy sources and quenched on a chill or quench wheel, and in particular, to the production of improved amorphous metal alloy filaments by casting in partial vacuum.

2. Description of the Prior Art

The process of fabricating metal filaments by extracting from a molten metal source and quenching on a quench wheel is often referred to as melt spinning of chill-block spinning. Typically, as taught in U.S. Pat. Nos. 2,825,108, 2,886,866 and 2,899,728, a free jet of molten material is impinged upon a moving quench surface in air, preferably a rotating wheel or continuous belt, and rapidly quenched to produce a product having superior physical properties. Various melt spinning techniques are employed to obtain solid solutions of metals that would normally separate on solidification due to mutual insolubility in the solid state. These techniques have long been employed to produce polycrystalline metal products possessing a very fine grain crystalline structure. More recently, melt spinning has been used to produce glassy or amorphous metal alloy filaments, which require quenching of the melt at a rate such that the particular alloy reaches its characteristic glass transistion temperature before departure from the quench source. Typically, quench rates of about $10^{5°}$ to $10^{6°}$ C./sec must be attained to achieve the desired amorphous structure.

As is well-known, an amorphous material generally characterizes a noncrystalline or glass material, that is, a material substantially lacking any long range order. In distinguishing an amorphous material from a crystalline material, X-ray diffraction measurements are generally suitably employed. Additionally, transmission electron micrography and electron diffraction can be used to distinguish between the amorphous and the crystalline state.

An amorphous metal produces an X-ray diffraction profile in which intensity varies slowly with diffraction angle. Such a profile is qualitatively similar to the diffraction profile of a liquid or ordinary window glass. On the other hand, a crystalline metal produces a diffraction profile in which intensity varies rapidly with diffraction angle.

These amorphous metals exist in a metastable state. Upon heating to a sufficiently high temperature, they crystallize with evolution of a heat of crystallization, and the X-ray diffraction profile changes from one having glassy or amorphous characteristics to one having crystalline characteristics.

It is possible to produce a metal which is totally amorphous or which comprises a two-phase mixture of the amorphous and crystalline state. The term "amorphous metal", as employed herein, refers to a metal which is at least 50% amorphous, and preferably 80% amorphous, but which may have some fraction of the material present as included crystallites.

For the purpose of the invention, the term "filament" is meant to include any slender metallic body whose transverse dimensions are substantially less than its length. These filaments may be ribbon, wire or sheet or may have an irregular cross-section.

Recent modifications in melt spinning processing techniques and apparatus have resulted in improved amorphous metal filaments. See, for example, U.S. Ser. No. 360,888, filed May 16, 1973 by J. R. Bedell, now U.S. Pat. No. 3,862,658, issued Jan. 28, 1975, which discloses extending the retention time of the molten stream of metal on the quench wheel. While such improvements are beneficial, a recurring problem remaining involves dimpling or blister formation on the filament surface which is in contact with the quench wheel.

SUMMARY OF THE INVENTION

In accordance with the invention, filaments of metal alloys are formed by melt-spinning in a partial vacuum with absolute pressure not greater than about 5.5 cm of Hg, and preferably in the range of about 100 μm to 1 cm of Hg. The filaments may be either amorphous as defined above, or fine-grain polycrystalline. As a consequence of casting in a partial vacuum, the filament surface in contact with the quench wheel more nearly replicates the quench wheel surface, thereby resulting in a reduction on the filament surface of dimpling, blister formation and related surface irregularities. Also unexpectedly, the ultimate tensile strength of a composition is substantially increased over the value of the same composition cast in air. In addition, reactive compositions, such as those containing high amounts of iron, which are formed only with difficulty in air, are easily formed in vacuum, without the attendant problems associated with oxidation, etc. Such high iron compositions typically consist essentially of about 75 to 85 atom percent iron, about 12 to 15 atom percent boron, about 5 to 7 atom percent carbon, about 2 to 4 atom percent silicon, and about 1 to 2 atom percent aluminum. About 10 to 15 atom percent iron may be replaced by chromium to improve physical and mechanical properties, such as strength, corrosion resistance and oxidation resistance.

Metal alloy compositions evidencing improved properties in accordance with the invention include compositions having the formula $T_iX_j$ where T is at least one transition metal, X is at least one of the metalloid elements of aluminum, antimony, beryllium, boron, germanium, carbon, indium, phosphorus, silicon and tin, "i" ranges from about 70 to 87 atom percent and "j" ranges from 13 to 30 atom percent. Preferably, T is at least one of the elements of vanadium, iron, cobalt, nickel and chromium, X is at least one of the elements of aluminum, boron, carbon, silicon and phosphorous, "i" ranges from about 75 to 85 atom percent and "j" ranges from about 15 to 25 atom percent.

Apparatus useful in the practice of the invention comprises (a) a crucible, which is provided with heating means, for containing the molten source of metal alloy, (b) a vacuum chamber provided with means for creating a partial vacuum, (c) a rotatable quench cylinder situated within the vacuum chamber, and (d) means for ejecting a stream of the molten metal alloy onto the rotatable quench cylinder.

DETAILED DESCRIPTION OF THE INVENTION

The description that follows is given generally in terms of producing amorphous metal alloy filaments. However, it will be clear to those skilled in the art of fabricating fine-grain polycrystalline metal alloy filaments directly from the melt, using somewhat lower quench rates, that the same improvements in surface characteristics will be obtained.

Amorphous metal alloys are formed by cooling a melt at a rate of about $10^{5°}$ to $10^{6°}$ C./sec. A variety of techniques are available, as is well known in the art, for fabricating splat-quenched foils and rapid-quenching continuous ribbon, wire, sheet, etc. Typically, a particular composition is selected, powders of the elements (or of materials that decompose to form the elements) in the desired proportions are melted and homogenized, and the molten alloy is rapidly quenched on a chill surface, such as a rotating cylinder. A similar procedure, using lower quench rates, is employed for forming fine-grain polycrystalline metal alloys filaments.

Many processes have been developed for producing solid metal filaments from the melt by bringing liquid in contact with a rapidly moving substrate which cools the liquid to the crystalline or glassy state by absorbing the heat. For a relatively smooth substrate surface in which sharply defined irregularties are less than about 5 μm, it is found that the surface of the filament which was in contact with the substrate (hereinafter "the contact surface") has a surface roughness greater than that of the substrate. The increased roughness is due to the presence of depressions or "dimpling" on this contact surface. Thus, the contact surface does not replicate the substrate surface, since only part of the contact surface of the filament is in contact with the substrate. Consequently, a reduced cooling rate is obtained for those portions of the contact surface not in actual contact with the substrate, resulting in a greater degree of crystallinity and thus an increase in brittleness. Further, in the case of very thin filaments (about 0.001 inch thick), the depressions may constitute an appreciable fraction of the macroscopic thickness of the filament.

These depressions are apparently due to the entrapment of gas from the surrounding atmosphere between the rotating substrate and the liquid. In accordance with the invention, gross surface defects and irregularities of metal filaments cast on a rotating cylinder are substantially eliminated by enclosing the substrate within a vacuum chamber, and casting the molten alloy on the substrate. The apparatus description that follows is given in terms of particular apparatus designed to demonstrate the effectiveness of the invention and, as such, is intended to be merely exemplary. The purity of materials used in casting metal filaments is that found in normal commercial practice.

Figure 1:
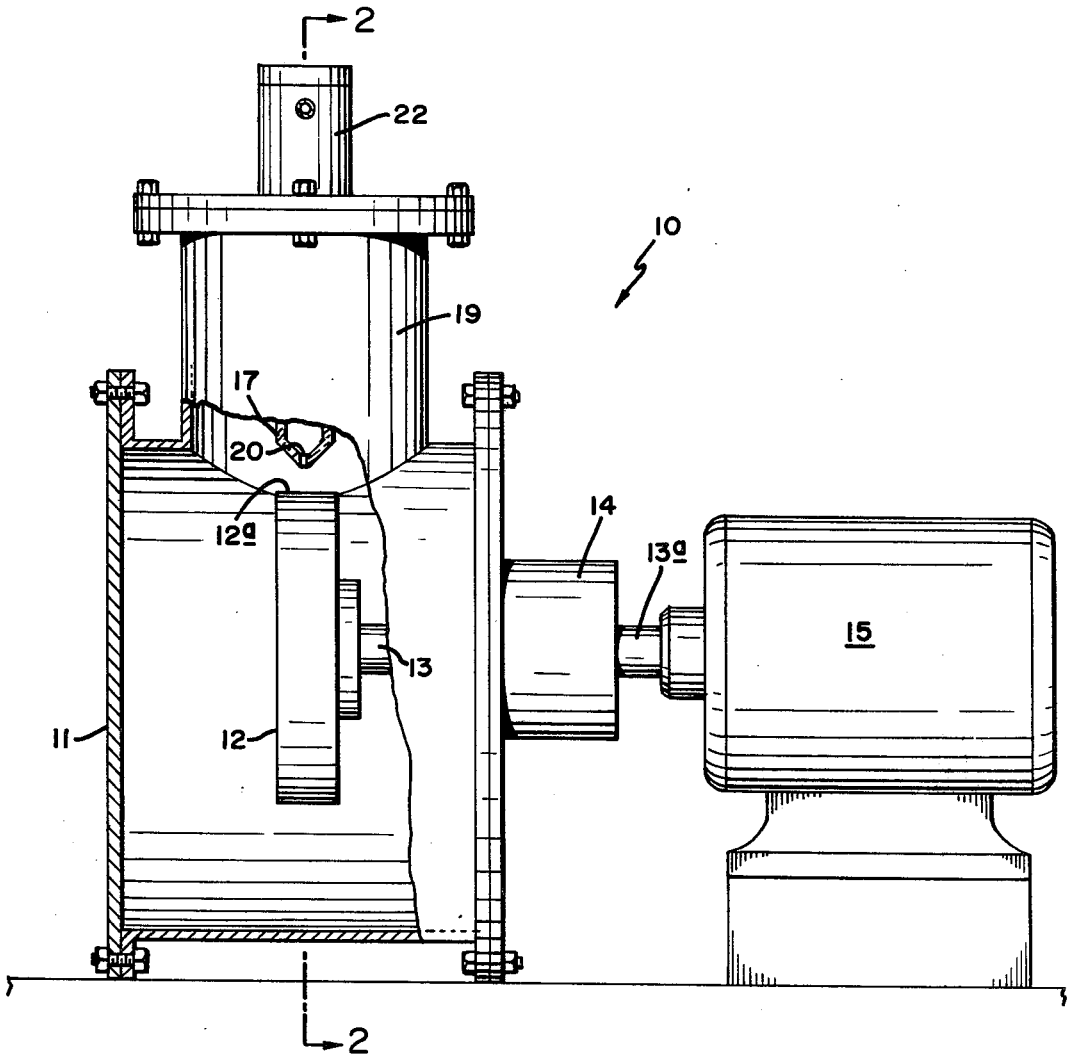
FIG. 1 is a side view, partly schematic and partly in cross-section, of apparatus useful for processing amorphous alloys in accordance with the invention.
Figure 2:
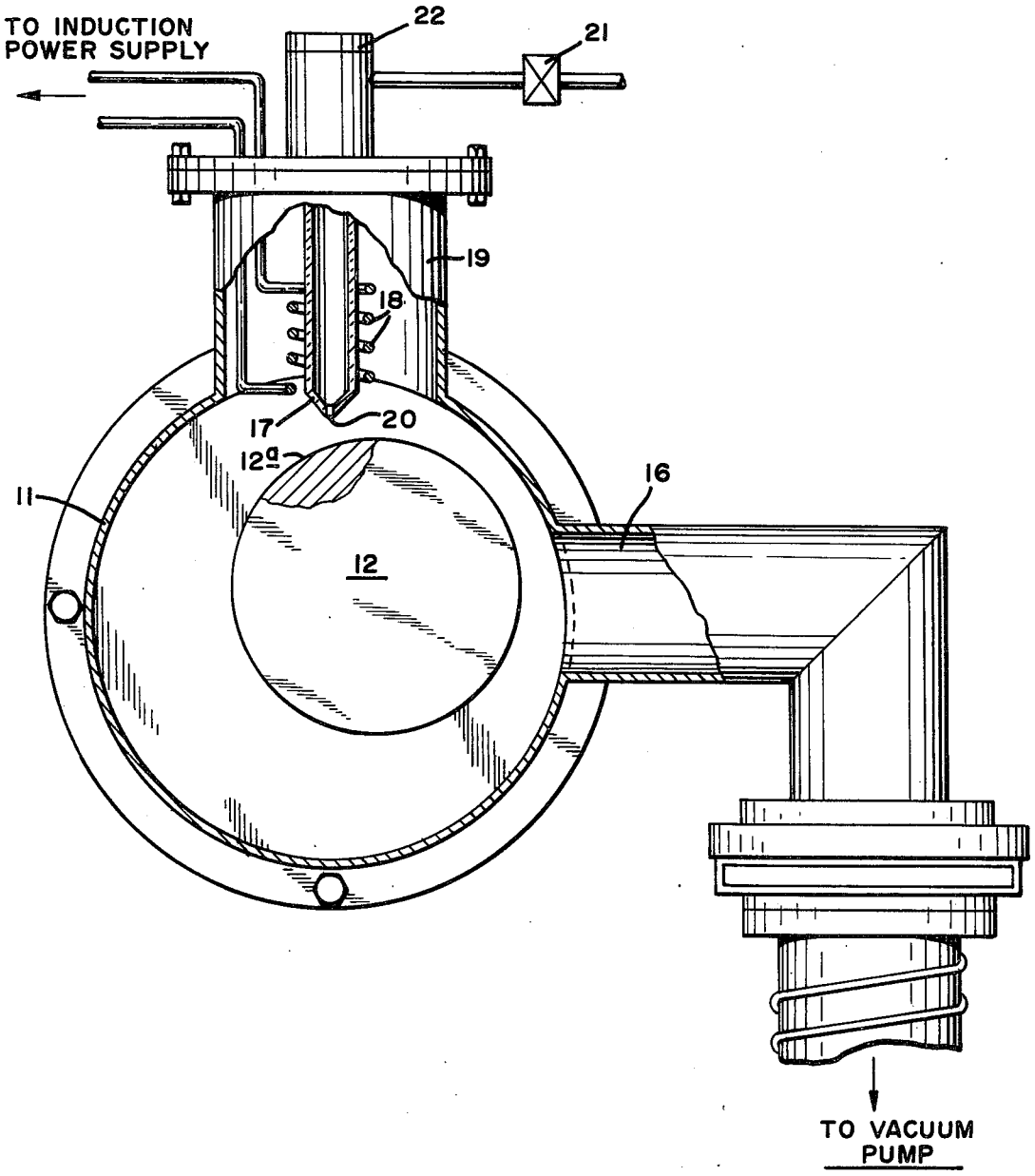
FIG. 2 is a front view, partly in cross-section, of a portion along 2—2 of the apparatus of FIG. 1.

Shown in FIGS. 1 and 2 is a vacuum chill casting apparatus 10, which comprises a vacuum chamber 11 and a rotatable cylinder 12 mounted on a shaft 13. The cylinder is driven through a vacuum rotary feedthrough 14 by a motor 15. A shaft 13*a* couples the motor to the rotary feedthrough. The vacuum chamber is conveniently stainless steel, and is connected through a port 16 to a vacuum pump (not shown) of sufficient capacity to attain a typical pressure of about $10^{-4}$μm of Hg. The rotatable cylinder is a high thermal conductivity material, such as copper. The cylinder may be cooled, if desired, by suitable cooling means, such as circulated chilled water, using appropriate vacuum feedthroughs. The motor is variable speed, in order to adjust the rotation rate of the cylinder to a desired value.

A crucible 17, surrounded by an induction coil assembly 18, is mounted within the vacuum chamber through a port 19. The crucible is a suitable non-reacting material, such as fused quartz, boron nitride, alumina, zirconia or beryllia. The induction coil assembly is connected to a suitable induction power supply (not shown).

Filaments are prepared by melting a metal alloy in the crucible and ejecting the melt through an orifice 20 in the bottom of the crucible by overpressure of a non-reactive gas, such as argon, exerted on the top of the melt. The non-reactive gas is admitted to the top of the melt through valve 21 and forces a stream of the melt onto surface 12*a* of the rotating cylinder.

The pressure inside the vacuum chamber, following an initial pump down to, for example, $10^{-4}$μm of Hg, is adjusted by admitting a non-reactive gas, such as argon, through the valve 21. A by-pass valve (not shown) within an assembly 22 permits the operator to introduce the non-reactive gas either into the vacuum chamber or to the top of the melt.

An apparatus and procedure such as that described above is suitable for casting metal filaments having improved surface character in accordance with the invention. Preferably, a similar apparatus and procedure is suitable for casting amorphous metal alloy filaments having improved surface character.

Figure 3A:
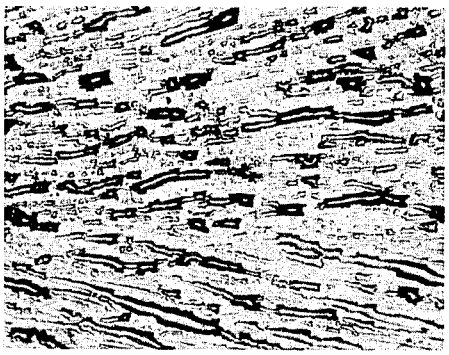
FIGS. 3A to 3F are photomicrographs (at 60× magnification) of surfaces of amorphous metal alloy filaments in contact with a chill wheel, illustrating the effect of various vacuum pressures on the character of the surface.
Figure 3B:
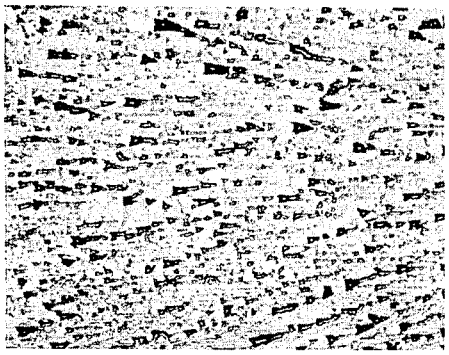
Figure 3C:
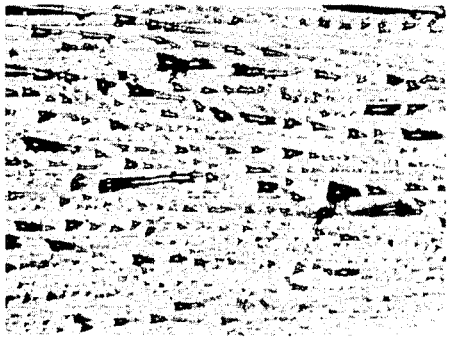
Figure 3D:
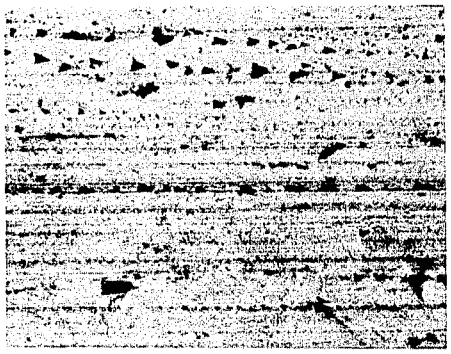
Figure 3E:
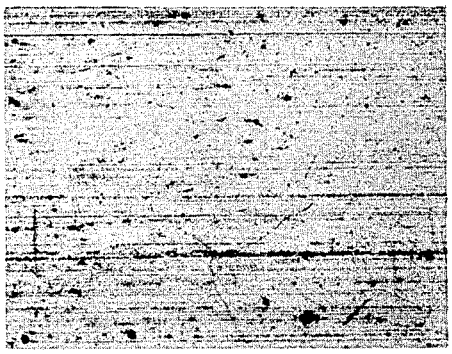
Figure 3F:
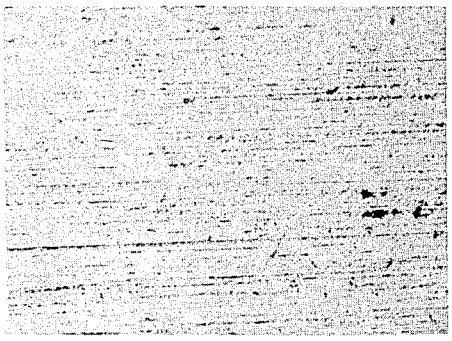

An example of the improvement achieved in accordance with the invention is shown in FIGS. 3A to 3F, which are photomicrographs of amorphous metal ribbon surfaces in contact with the quench wheel during quenching. The alloy is $Fe_{25}Ni_{25}Co_{20}Cr_{10}B_{20}$ (the subscripts are in atom percent). Each photomicrographs (at 60× magnification) illustrates the effect of the pressure of partial vacuum (as adjusted by argon gas) in which the ribbon was cast: FIG. 3A at 60 cm of Hg; FIG. 3B at 40 cm of Hg; FIG. 3C at 10 cm of Hg; FIG. 3D at 5.5 cm of Hg; FIG. 3E at 1 cm of Hg; and FIG. 3F at 200 μm (0.02 cm) of Hg. It is clear that as the argon pressure is reduced, the quality of the surface improves, such that substantial improvement is achieved at partial vacuum pressures of about 5.5 cm and lower. From a pressure of about 100 μm to $10^{-4}$μm, no substantial further improvement is observed. The vacuum pressure range from 100 μm to 1 cm is relatively easy to attain with conventional equipment, and in view of the improvement obtained using vacuum pressure less than about 1 cm, the range of about 100 μm to 1 cm is preferred.

Figure 4A:
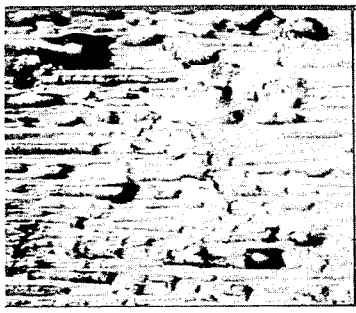
FIGS. 4A and 4B are photomicrographs (at 240× magnification) of surfaces of amorphous metal alloy filaments in contact with a chill wheel, comparing the effect on the surface character resulting from casting in air versus casting in vacuum.
Figure 4B:
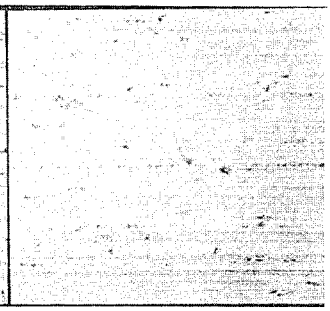
Figure 5A:
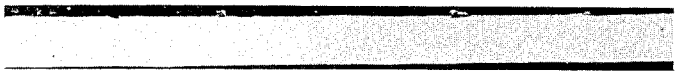
FIGS. 5A and 5B are photomicrographs (at 600× magnification) of cross-sections of amorphous metal alloy filaments in contact with a chill wheel, comparing the effect of the surface character resulting from casting in air versus casting in vacuum.
Figure 5B:
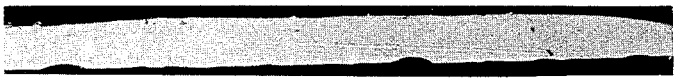

In FIGS. 4A and 4B, the effect on the surface character of casting in air versus casting in vacuum is shown. The magnification is 240× and illustrates the reduction in blister formation achieved in accordance with the invention. In FIGS. 5A and 5B, which are cross-sectional views comparing the effects of casting in air (FIG. 5B) versus casting in vacuum, (FIG. 5A) it can be seen that the depressions in the surface in contact with the chill wheel obtained by casting in air are substantially eliminated by casting in vacuum. In FIGS. 5A and 5B, the bottom surface was in contact with the chill wheel. The magnification is 600×.

Also unexpectedly, the mechanical properties of amorphous alloys fabricated in accordance with the invention are greatly improved. For example, the composition $Fe_{29}Ni_{49}P_{14}B_6Al_2$ has an ultimate tensile strength of 280,000 psi when cast in air at 1 atm and 310,000 psi when cast in a vacuum of 100 μm. The composition $Fe_{74.3}Cr_{4.5}B_{0.38}C_{4.95}P_{15.8}$ has an ultimate tensile strength of 250,000 psi when cast in air at 1 atm and 350,000 psi when cast in a vacuum of 100 μm.

By casting in a vacuum in accordance with the invention, certain classes of amorphous metal alloys, such as high iron compositions, are considerably easier to fabricate than in air. Typically, the high iron amorphous alloys consist essentially of about 75 to 85 atom percent iron, about 12 to 15 atom percent boron, about 5 to 7 atom percent carbon, about 2 to 4 atom percent silicon, and about 1 to 2 atom percent aluminum. For example, the composition $Fe_{77}B_{15}C_5Si_1Al_2$ tends to oxidize in air and forms an amorphous alloy only with difficulty that is generally brittle. Cast in a vacuum, this same composition is ductile to bending, and can withstand permanent deformation without cracking. Such high iron compositions are remarkably strong, with ultimate tensile strengths approaching 500,000 psi.

Replacing about 10 to 15 atom percent iron with chromium in the high iron base amorphous alloys increases the strength, corrosion resistance and oxidation resistance of these alloys. These alloys are accordingly suitable for applications as high strength, corrosion resistant structural materials.

The amorphous alloy compositions for which reduction in surface irregularities and improved ultimate tensile strength of filaments can be expected may be selected from several classes of compositions, an example of which is $T_iX_j$, where T is at least one transition metal and preferably vanadium, iron, cobalt nickel and chromium, X is at least one of the metalloid elements of aluminum, antimony, beryllium, boron, germanium, carbon, indium, phosphorus, silicon and tin and preferably aluminum, boron, carbon, silicon and phosphorous, "i" ranges from about 70 to 87 atom percent, and preferably about 75 to 85 atom percent, and "j" ranges from about 13 to 30 atom percent, and preferably about 15 to 25 atom percent. A transition metal is an element listed in Groups IB to VIIB and VIII of the Periodic Table.

EXAMPLES

1. A ribbon of amorphous $Fe_{29}Ni_{48}P_{14}B_6Al_3$ is formed by squirting the molten alloy (at about 950° C.) of this composition through a 0.015 inch hole in the bottom of a quartz tube, using an applied pressure of about 7 psi, onto the outside surface of a copper cylinder (about 18 inches diameter) rotating at about 1000 rpm which has been abraded with 600 grit paper. A ribbon formed in the atmosphere exhibits "depressions" in its substrate surface, while one formed in a high partial vacuum replicates the surface of the cylinder.
2. Apparatus similar to that shown in FIGS. 1 and 2 was constructed. The rotating cylinder was copper, about 8 inches in diameter and having a width of about 1.5 inches. The vacuum chamber was a 12 inch I.D. by 10 inch long stainless steel cylinder flanged at two ends with two side ports. A 4 inch diffusion pumping system was used to evacuate the chamber. A 10 kW, 50 kHz induction power supply was used to melt metal alloys. Amorphous metal alloy ribbons were prepared by melting about 10 g of the alloy in a suitable non-reacting crucible and ejecting the melt by over-pressure of argon through an approximately 0.040 inch hole at the bottom of the crucible into the rotating copper cylinder. The cylinder was rotated at a velocity of about 1500 to 2000 rpm. The melting and squirting were carried out in vacuum at a pressure of about $10^{-4}$ μm, using argon gas to adjust the pressure. In Table I below are given compositions used in forming metal alloy ribbons in accordance with the invention, and the ultimate tensile strength (psi), crystallization temperatures (° C.), and hardness (DPH) of the ribbons.

TABLE I

Data on Mechanical and Thermal Properties of Ribbons of Amorphous Metal Alloys

| Composition (atom percent) | Ultimate Tensile Strength, (psi) | Crystallization Temperature (°C.) | Hardness (DPH) |
|---|---|---|---|
| $Fe_{77}B_{15}C_5Si_1Al_2$ | 486,000 | 510, 529 | 1044 |
| $Fe_{66}Cr_{12}B_{15}C_5Si_2$ | 434,000 | 550 | 1097 |
| $Fe_{60}Cr_{18}B_{15}C_5Si_2$ | 438,000 | 578 | 1110 |
| $Fe_{28}Ni_{30}Co_{20}B_{16}Si_4Al_2$ | 338,000 | 479, 520 | — |
| $Fe_{28}Ni_{28}Co_{20}B_{18}C_2Si_2Al_2$ | 320,000 | 490 | — |

In Table II, the effect of casting ribbons in various vacuum pressures on the ultimate tensile strength of one particular amorphous metal alloy is shown. It is seen that the use of moderate vacuum results in improved strength.

TABLE II

Ultimate Tensile Strength as a Function of Pressure

| Composition (atom percent) | Chamber Pressure (cm of Hg) | Ultimate Tensile Strength (psi) |
|---|---|---|
| $Fe_{25}Ni_{25}Co_{20}Cr_{10}B_{20}$ | 19 | 260,000 |
| | 10 | 390,000 |
| | 5.5 | 410,000 |
| | 1 | 450,000 |
| | 0.02 | 520,000 |

We claim:

1. A process for forming an amorphous metal alloy filament comprising:
   (a) forming a melt of an alloy composition which, upon rapid quenching from the melt, forms an amorphous solid; and
   (b) depositing a stream of the molten metal alloy on a rapidly moving chill surface under partial vacuum with pressure not higher than about 5.5 cm. Hg. to quench the molten metal to form an amorphous metal alloy filament having reduced surface irregularities and improved tensile strength.
2. The process of claim 1 in which the absolute pressure ranges from about 100 μm to 1 cm of Hg.

3. The process of claim 1 in which
the molten metal alloy is quenched at a rate of about $10^{5°}$ to $10^{6°}$ C./sec.

4. The process of claim 3 in which the metal alloy comprises $$T_iX_j$$

where T is at least one transition metal selected from the group consisting of elements listed in Groups IB to VIIB and VIII of the Periodic Table, X is at least one of the elements selected from the group consisting of aluminum, antimony, beryllium, boron, germanium, carbon, indium, phosphorus, silicon and tin, "i" ranges from about 70 to 87 atom percent, and "j" ranges from about 13 to 30 atom percent.

5. The process of claim 4 in which T is at least one of the elements selected from the group consisting of vanadium, iron, cobalt, nickel and chromium, X is at least one of the elements selected from the group consisting of aluminum, boron, carbon, phosphorus and silicon, "i" ranges from about 75 to 85 atom percent and "j" ranges from about 15 to 25 atom percent.

* * * * *